United States Patent [19]

Ellgass

[11] Patent Number: 4,718,563

[45] Date of Patent: Jan. 12, 1988

[54] OVERHEAD GANTRY

[75] Inventor: Louis Ellgass, Estavayer-le-lac, Switzerland

[73] Assignee: L. Ellgass SA, Switzerland

[21] Appl. No.: 788,232

[22] Filed: Oct. 17, 1985

[30] Foreign Application Priority Data

Oct. 20, 1984 [CH] Switzerland ..... 5020/84

[51] Int. Cl.[4] ..... B66C 11/00

[52] U.S. Cl. ..... 212/142.1; 212/204; 212/218; 212/182; 116/63 P

[58] Field of Search ..... 212/142.1, 149, 204, 212/208, 218, 244, 254, 265, 175, 182; 116/63 P, 63 R, 202; 248/121

[56] References Cited

U.S. PATENT DOCUMENTS

| | | | |
|---|---|---|---|
| 2,343,014 | 2/1944 | Langan | 212/218 |
| 2,419,145 | 4/1947 | Kersenbrock et al. | 212/199 |
| 4,543,905 | 10/1985 | McKenney | 116/63 P |
| 4,616,225 | 10/1986 | Woudenberg | 212/182 |

FOREIGN PATENT DOCUMENTS

| | | | |
|---|---|---|---|
| 1266570 | 11/1961 | France | 212/218 |
| 2420502 | 11/1979 | France | 212/218 |
| 502442 | 11/1954 | Italy | 116/63 P |
| 275559 | 5/1951 | Switzerland | 212/218 |
| 2031363 | 4/1980 | United Kingdom | 212/249 |
| 586097 | 12/1977 | U.S.S.R. | 212/218 |

*Primary Examiner*—Joseph F. Peters, Jr.
*Assistant Examiner*—Stephen P. Avila
*Attorney, Agent, or Firm*—Steele, Gould & Fried

[57] ABSTRACT

The instant invention concerns a transportable overhead gantry for spanning a roadway having two supports linked in an articulated manner to a cross-member. The cross-member is adjustable for height, for example using a winch operable to move the cross-member along the supports and, being made up of three or four parts, can be telescopically retracted. The supports can be folded towards each other in a plane defined by the cross-member so that the entire overhead gantry can be transported on a conventional truck. The overhead gantry can be erected at any point along a multi-lane expressway without special machinery or equipment and is thus suitable for the rapid and temporary display of traffic signs.

10 Claims, 3 Drawing Figures

OVERHEAD GANTRY

The invention relates to a transportable overhead gantry for spanning a roadway such as an expressway comprising two supports linked by a cross-member for vertical traffic signs, in particular for such signs on multi-lane roads.

BACKGROUND OF THE INVENTION

On expressways and other multi-lane roads, for vertical traffic signs such as direction signs and traffic lights to be clearly visible to vehicles on the outside (fast) lanes they cannot be erected only at the edge of the expressway, but must be mounted on overhead gantries which extend over the roadway. Such overhead gantries are also known as trestle bridges or overhead information signs.

No really satisfactory solution exists as yet where temporary expressway signs are required. When permanently installed traffic signs have to be altered temporarily a provisional sign or a fabric covering is often hung over the traffic sign with the aid of a vehicle equipped with a lifting platform.

Apart from the disruption to traffic involved in this procedure, the rapid or temporary erection of traffic signs over the roadway is not solved where there is no permanently installed overhead gantry. This situation can, for example, arise when sudden diversions, unusual destinations or the like have to be signposted.

OBJECT OF THE INVENTION

It is an object of the instant invention to provide a means for erecting temporary vertical road signs on expressways and other roadways with a minimum of hindrance or disruption to traffic.

The above object is achieved by the instant invention by means of an overhead gantry of the type referred to above, wherein the supports are provided with lifting devices for lifting and lowering the cross-member, the supports are composed of masts which can be inclined towards one another when the cross-member is lowered and the cross-member comprises mutually telescopically retractable sections. These sections may retract over or within one another.

BRIEF SUMMARY OF THE INVENTION

The cross-member is mounted in an articulated manner on the supports, whereby the articulated joints can be locked in position by means of struts. The means of elevating the cross-member may be any conventional method. It may, for example, be a motor-driven or manually operated system. Motor driven systems may use electric motors or hydraulic systems with pistons. A typical manual system will involve cables and a winch. Cable lifting devices are preferably provided with self-acting brakes in the event of a cable severing. The lower ends of the masts are conveniently provided with support members disposed at right angles to the cross-member, said cross-member being equipped with wheels and fixing devices.

DESCRIPTION OF THE DRAWINGS

Preferred embodiments of the instant invention will now be described with particular reference to the description based on the drawings appended hereto. There is shown in FIG. 1 a perspective general view of an assembled overhead gantry, FIG. 2 a perspective view of a part of the lifting device, FIG. 3 a schematic representation of the sequence of erecting the overhead gantry.

The overhead gantry shown in FIG. 1 consists essentially of two supports 11, 12 and a cross-member 13 located therebetween for carrying traffic signs 9. The support 11 consists of a double mast 14 composed of two parallel tubes 15, 16 of equal length having a square cross section. The tubes 15, 16 are fixed to a support member 17 perpendicular thereto, preferably by welding. The support member 17 is provided at its outer ends with fixed wheels 18. In addition, support member 17 has fixing devices 19 which are adjustable for height in a conventional manner in order to deactivate wheels 18 and thus prevent the support from rolling away and also to enable the gantry to be mounted level on uneven terrain.

Figure 1:
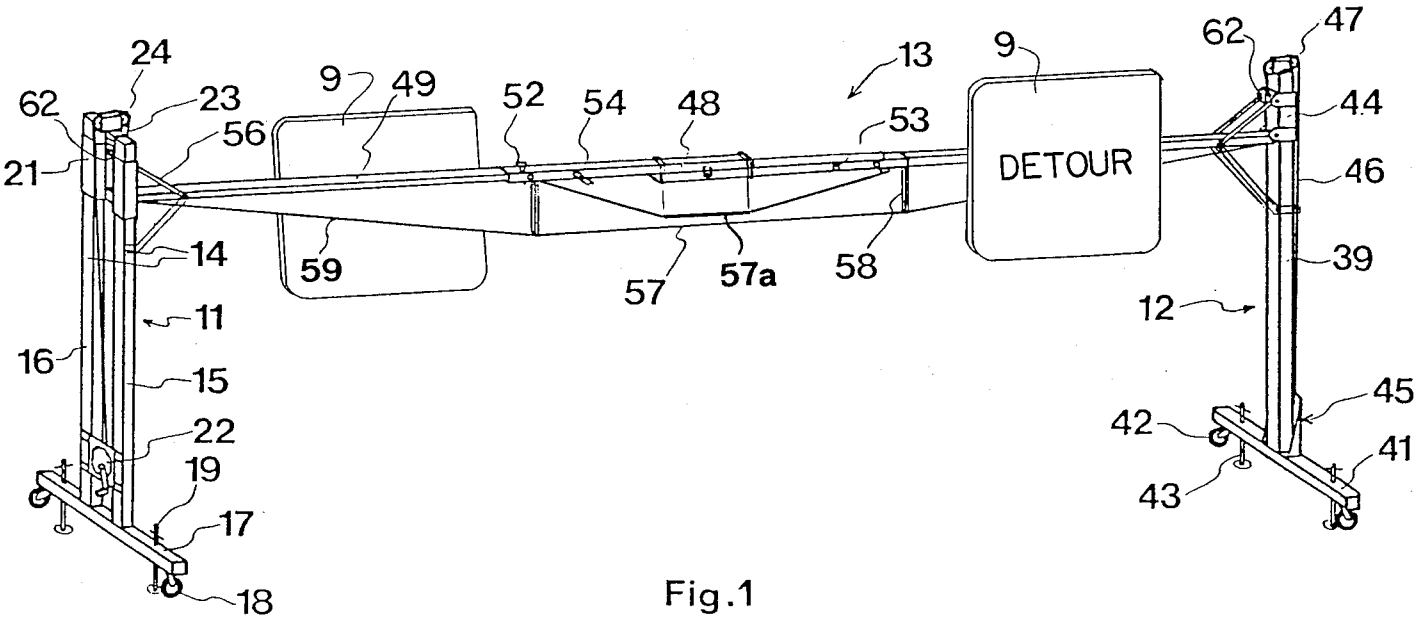

The mast 14 is equipped with a lifting device which is composed of a carriage 21, a winch 22 with cable 23 and pulleys 24 at the head of the mast. This elevating means may otherwise comprise an electric motor or hydraulic means.

Figure 2:
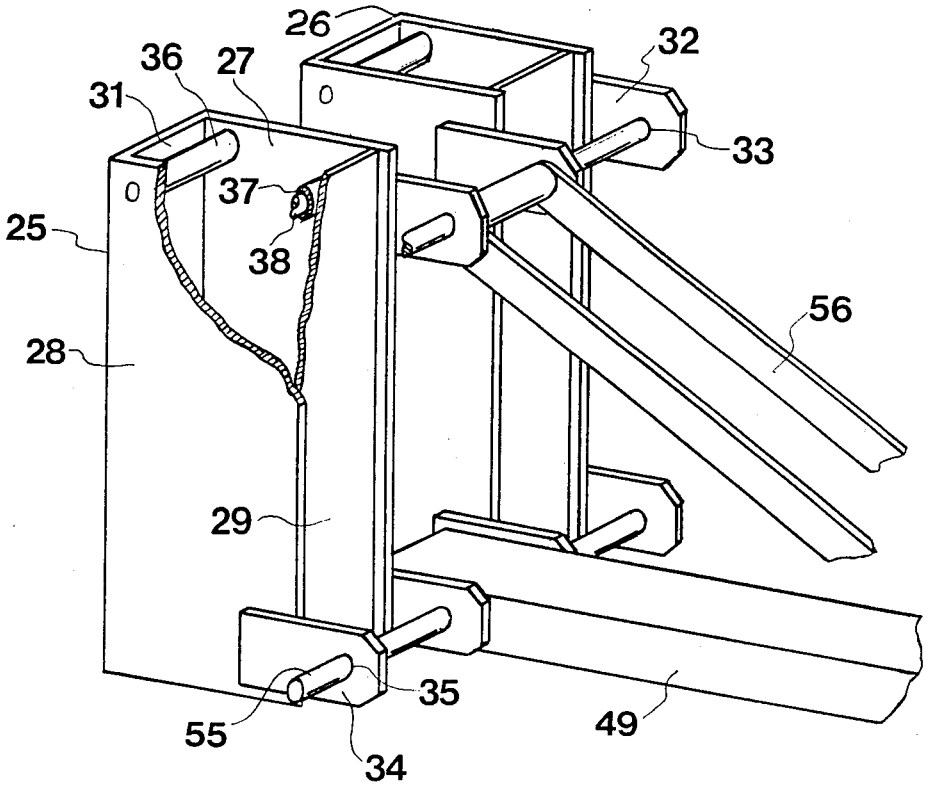

The carriage 21 is shown in detail in FIG. 2. It consists essentially of two rectangular tubular sections 25, 26 the size of which enables them to fit over tubes 15,16. One tubular section consists of two side walls 27, 28, a front wall 29 and a back wall 31. The two side walls 27,28 are at a distance from one another which is slightly (e.g. 0.2") greater than the outer dimension of tube 15. Front wall 29 and back wall 31 have a distinctly larger distance from one another, the purpose of which will be set out below.

The pipe sections 25,26 are arranged in parallel at a distance from one another which corresponds to the distance of the two tubes 15,16 of mast 14. At their upper ends the tubular sections 25,25 are provided with plates 32 fixed, e.g. welded, in pairs to the two side walls 27,28, said plates projecting beyond the front wall. The plates 32 are provided with holes 33 of the same diameter in such a way that all the holes align with one another. At their lower ends the tubular sections possess similarly arranged pairs of plates 34 which project in the same way as the upper ones and which are provided with holes 35 which align with one another.

The inside of each tubular section is provided at its upper and lower ends with a pair of rollers 36 which are arranged parallel to the front wall 29 or the back wall 31 and at a small distance therefrom. The rollers consist of sleeves 37 which are swivel mounted on bolts 38 extending vertically to side walls 27,28 and extending through these. The distance between the rollers of each pair equals the outer dimension of the corresponding tube of mast 14. The rollers serve to reduce friction between carriage 21 and mast 14.

One end of cable 23 is fitted to carriage 21 and runs over the pulleys 24 to winch 22. Winding up or unwinding the cable 23 raises or lowers the carriage in relation to the mast.

In contradistinction to support 11, support 12 consists of a simple mast 39 on a transverse support member 41 with which it is rigidly linked. In other respects support 12 is similarly equipped as support 11, i.e. support member 41 has wheels 42 and fixing devices 43 and the mast is provided with a lifting device consisting of a carriage 44, a winch 45 with cable 46 and pulley wheels 47. The carriage 44 only differs from carriage 21 in that it is composed of only one tubular section. Otherwise its construction is essentially similar to that of carriage 21.

The wheels 42 differ from wheels 18 in that their shafts are not fixed, but can pivot about a vertical bolt.

The cross-member 13 which links the two supports 11, 12 consists essentially of three or four individual tubular sections. These may be of tubular or rectangular cross section. A central portion 48 is constructed in the form of a double tube. Two tubes of equal length and rectangular cross section are mounted parallel with one another. They may be slid along each other and are held together by a series of pins passing through holes in the tubes. For a more permanent installation the tubes may be welded together. In another embodiment the two tubes composing the central section may be closed at one end. In this case, their openings are at opposite ends to one another, in each case at the projecting end of the tube. To tension the assembly together, one may use cables 59, one of which may be in the form of a chain.

Two side parts 49,51 of cross-member 13 consist of rectangular tubes, the outer cross section of which fits into the internal cross section of the tubes of central section 48 so that side sections 49,51 can be inserted into central section 48. In this way the cross-member 13 can be shortened to somewhat more than a third of its maximum length. In order to tension up the gantry between the uprights, one may use cables, one of which may conveniently be in the form of a chain.

At a short distance from the open ends of the two tubes of the central section 48 are provided adjusting screws 52 which are inserted vertically in threads in the central section and with which the side sections 49,51 can be fitted and, above all, play between the central and side sections can be avoided.

In addition, the central section 48 of the two tubes has horizontal through holes 53 which align in certain withdrawn positions of side sections 49,51 with holes (not shown) in the ends of the side sections located in the central section so that fitting pins 54 can be inserted through them in order to fix the specific extended positions.

At their other ends the side sections also have holes (not shown) through which the pins or axles 55 can be inserted to link up with the lower plates 34 located on carriages 21,44. The width of the side sections determines the distance between the plates.

Plates 32 at the upper end of the carriage serve to fit additional bracing struts 56, the other ends of which can be linked by means of appropriate pins through additional holes in the side sections to said side sections. The holes in the side sections are preferably strengthened with bushes.

A further bracing device is formed by a cable 57 which is tensioned below cross-member 13 between the ends of the side sections over supports 58 on the underside of the central section.

The two tubular sections 25,26 of carriage 21, as well as carriage 44 having only one tubular section, have self-acting fall brakes 62 which hold the appropriate carriage should a cable 23,46 sever. The brakes consist of a conventional blocking device which clamps the relevant carriage to the mast should a cable sever.

The individual parts of the overhead gantry are preferably of galvanized steel. The maximum width of the bridge in assembled state is about 45 feet and is so designed as to span three-lane expressways with breakdown lane. The headroom of the erected bridge is about 15 feet, the overall height ca. 20 feet. These dimensions do not, however, consistute any limitations. Unloading and erection of the overhead gantry can be effected by four workmen without special aids.

Figure 3:
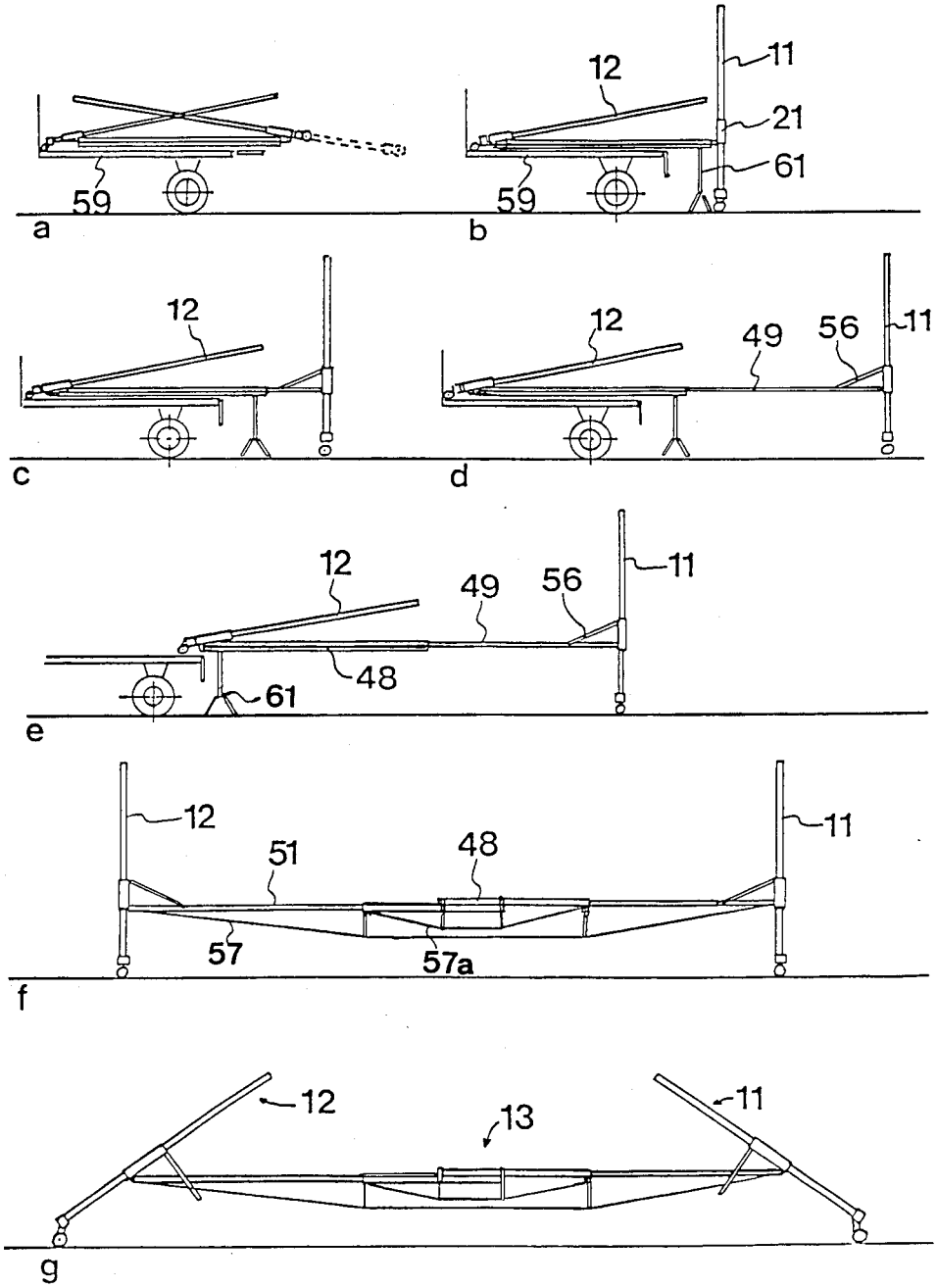

Axles 55 with which side sections 49,51 of cross-member 13 are linked to carriages 21,44 have a central function. They serve as pivots when the overhead gantry is folded for transport purposes. When struts 56 are loosened by withdrawing the linkage bolts in the side sections, the masts can be folded down. When, additionally, cross-member 13 is pushed together the transport configuration is obtained. The individual steps and configurations are shown in sequence in FIG. 3.

FIG. 3*a* shows the folded overhead gantry on the loading surface of a transport vehicle 59. Support 11 with the double mast is located at the rear, i.e. where unloading takes place. First of all support 11 is slid rearing wardly by about 4 feet (shown in dotted lines). The carriage is blocked using the winch and then the mast is erected (FIG. 3*b*). The central section 48 of the cross-member is then supported from below by means of a jack 61 or similar device. Support 11 is then pushed out sufficiently far to enable the side section 49 to be drawn so far out of the central section that struts 56 can be fixed to the side section (FIG. 3*c*). Side section 49 is then pulled out of the central section by the desired length (FIG. 3*d*). Once in the desired position the appropriate pin 54 is inserted and fixing screw 52 tightened. By driving support 11 steadily backwards the other end of central section 48 comes onto the jack 61 (FIG. 3*e*). The transport vehicle 59 is now free and can drive off. The same procedure is now followed in respect of the other support 12. Finally, the tensioning cables 57 and 57*a* are fitted and tensioned (FIG. 3*f*). The gantry is now ready to have traffic signs fitted to it. When this has been completed the cross-member 13 is lifted to the desired height with winches 22,45.

All the steps hitherto described can be carried out in the breakdown lane or beside the roadway, by erecting the overhead gantry parallel to the flow of traffic. Only when it is completely ready and the traffic signs have been erected is it swung round in such a way as to span the roadway. This only requires stopping the traffic for a few moments. In its finally erected state, i.e. spanning the roadway, the overhead gantry is preferably secured by means of two or more retaining cables per mast, these being tensioned slanting downwards from the head of the mast.

FIG. 3*g* shows a position in which the overhead gantry can be transported and, if necessary also towed, for longer distances. For this purpose it suffices to loosen struts 56 from side sections 49,51 so that the supports can be partially tipped towards one another in order to reduce their overall height under the headroom normally allowed for road passage.

Where the roadway is very broad a third mast may become necessary to provide sufficient support for the cross-member.

I claim:

1. A transportable overhead gantry for spanning a roadway, comprising:

two supports defining masts and one cross-member for carrying traffic signs, the supports being provided with lifting means for lifting and lowering the cross-member along the supports, the supports being foldable towards one another in a plane of the cross-member and the cross-member being telescopically retractable, whereby the gantry can be folded up with the cross-member lowered and transported on a truck, and further comprising a self-acting brake operable to fix the cross-member to the supports in the event of failure of the lifting means.

2. An overhead gantry according to claim 1, wherein the cross-member is connected in an articulated manner with the supports and further comprising struts connectable to the cross-member to reinforce joints between the cross-member and the supports.

3. An overhead gantry according to claim 1, wherein lower ends of the masts are rigidly attached to support members mounted perpendicular to the cross-member.

4. An overhead gantry according to claim 3, further comprising wheels on the support members.

5. An overhead gantry according to claim 4, wherein the wheels are fixed to one of the support members by means of pivoting axles.

6. An overhead gantry according to claim 4, further comprising fixing devices on the support members for fixing the gantry in place.

7. A transportable overhead gantry for spanning a roadway, comprising:

two supports defining masts and one cross-member for carrying traffic signs, the supports being provided with lifting means for lifting and lowering the cross-member along the supports, the supports being foldable towards one another in a plane of the cross-member and the cross-member being telescopically retractable, whereby the gantry can be folded up with the cross-member lowered and transported on a truck, the lifting means being a cable operated mechanism and further comprising a self-acting brake operable to fix the cross-member to the supports in the event of a cable severing.

8. A transportable overhead gantry, comprising:

two support masts;

a cross-member supported on the support masts, the cross-member having telescopic sections and means for receiving traffic signs; and, carriages movable along each of the support masts, and lifting means operable to lift and lower the carriages along the support masts, the carriages being pivotally attached to the cross-member at joints permitting the support masts to be folded in a plane defined by the cross-member, whereby the gantry is foldable for transport and erectable along a shoulder of a road, and wherein the carriages are pivotable along an axis perpendicular to the cross-member and perpendicular to the masts, and further comprising a reinforcing strut removably attachable between the cross-member and the carriage at a space from said axis.

9. An overhead gantry according to claim 8, wherein the masts are elongated tubes and the carriages comprise substantially tubular sections enclosing the masts and slidable on the masts.

10. An overhad gantry according to claim 9, wherein the elongated tubes of the masts are rectangular.

* * * * *